United States Patent [19]

Hertel et al.

[11] 3,961,884

[45] June 8, 1976

[54] PROCESS FOR DYEING TEXTILE MATERIAL OF POLYESTER FIBER/CELLULOSE BLENDS

[75] Inventors: Hasso Hertel, Muhlheim, Main; Willy Gronen, Kelkheim, Taunus; Hans Kaiser, Offenbach, Main, all of Germany

[73] Assignee: Hoechst Aktiengesellschaft, Frankfurt am Main, Germany

[22] Filed: Sept. 12, 1974

[21] Appl. No.: 505,500

[30] Foreign Application Priority Data

Sept. 15, 1973 Germany ..... 2346504

[52] U.S. Cl. ..... 8/21 C; 8/44; 8/45; 8/46

[51] Int. Cl.[2] ..... D06P 3/82

[58] Field of Search ..... 8/21 C, 46

[56] References Cited

UNITED STATES PATENTS

| | | | |
|---|---|---|---|
| 3,642,424 | 2/1972 | Lowenfeld et al. | 8/21 C |
| 3,708,257 | 1/1973 | Lowenfeld et al. | 8/21 C |
| 3,713,767 | 1/1973 | Lowenfeld et al. | 8/21 C |

FOREIGN PATENTS OR APPLICATIONS

| | | | |
|---|---|---|---|
| 1,147,546 | 4/1969 | United Kingdom | 8/21 C |

*Primary Examiner*—William F. Hamrock
*Attorney, Agent, or Firm*—Curtis, Morris & Safford

[57] ABSTRACT

Process for the continuous dyeing of polyester fiber/-cellulose blends with disperse dyestuffs and water-insoluble azo developing dyestuffs by padding the fibrous material with an aqueous solution of at least one ice-color coupling component, an alkaline agent and an alkali metal nitrite, then cross-padding the material so impregnated with a second aqueous bath of room temperature which contains at least one diazotizable amine, at least one thermosolable disperse dyestuff and an acidifier, and finally successively promoting the formation of the azo dyestuff by diazotizing and coupling as well as fixing the disperse dyestuff with the aid of elevated temperature.

8 Claims, No Drawings

PROCESS FOR DYEING TEXTILE MATERIAL OF POLYESTER FIBER/CELLULOSE BLENDS

The present invention relates to a process for dyeing textile material made of polyester fiber/cellulose blends.

In the preparation of full, intense dyeings on textile material made of spun blends of polyester/cellulose fibers the cellulose portion of the material is advantageously dyed with developing dyestuffs for technical and economical reasons.

The operational method for a continuous dyeing of piece goods introduced in practice is as follows: The material to be dyed is padded on a padding machine firstly with an alkaline solution of a coupling component usable in the ice-color dyeing technique and is led after an intermediate drying through a developing bath which contains a diazonium salt solution of an aromatic amine, the dyestuff being formed on the cellulose component of the textile material. The washed material which is once more subjected to intermediate drying is padded on a second padding machine with the preparation of a disperse dyestuff, dried and then thermosoled for fixing the dyestuff, in which case the polyester portion of the fiber blend is dyed. By rinsing, washing and drying the dyeing is finished as usual.

Now, it was found that this complicated operational method of the state of the art can considerably be simplified and the textile material of polyester/cellulose blends can continuously be dyed with disperse dyes and water-insoluble azo dyestuffs produced on the fiber, when the fibrous material is padded with a preferably hot, aqueous solution, containing at least one coupling component usable in the ice-color technique, an agent of alkaline effect and an alkali metal nitrite, the material so impregnated is cross-padded, preferably after an intermediate drying, with a second aqueous bath of room temperature containing a solution, a dispersion or an emulsion of at least one diazotizable amine (as free base or salt) convenient for the ice-color dyeing technique, at least one thermosolizable disperse dyestuff and an agent of acid effect, and finally the azo dyestuff is formed by diazotizing and coupling and the disperse dye is fixed with the aid of elevated temperature.

According to the inventive process the formation of the azo dyestuff occurs immediately after the application of the second padding liquor and is terminated already after the exposition to air or after predrying prior to the thermosoling operation, depending on the amine used. In the thermosol process itself the disperse dyestuff is fixed on the polyester fiber.

Suitable coupling components for the new process are, preferably, low-substantive or medium-substantive aryl amides of the acetoacetic acid, the 2-hydroxy-naphthalene-3-carboxylic acid or the heterocyclic o-hydroxycarboxylic acids which are, for example 5-chloro-2-acetoacetylamino-1,4-diethoxy-benzene, 4,4'-bis-(acetoacetylamino)-3,3'-dimethyl-diphenyl and 2-acetoacetylamino-6-ethoxy-benzthiazole, moreover, 2-hydroxy-naphthalene-3-carboxylic acid-phenyl amides and their derivatives substituted in the phenylamido radical by alkyl, alkoxy or chlorine radicals, such as the 2-hydroxy-naphthalene-3-carboxylic acid-(2'-methyl-phenyl-1')-amide, 2-hydroxy-naphthalene-3-carboxylic acid-(2'-methoxy-phenyl-1')-amide, 2-hydroxynaphthalene-3-carboxylic acid-(3'-chloro-6'-methoxy-phenyl-1')-amide and the 2-hydroxy-carbazole-3-carboxylic acid-(4'-chlorophenyl-1')-amide.

Suitable agents of alkaline effect are in the impregnation liquids mainly aqueous solutions of the hydroxides of the alkali metals, above all sodium hydroxide solution.

Suitable amines for the preparation of the solutions, dispersions or emulsions for the formation according to the invention of the diazo component are:

Nitroanilines for example
- 2-nitroaniline (C.I. No. 37025)
- 3-nitroaniline (C.I. No. 37030)
- 4-nitro-2-amino-anisole (C.I. No. 37130)
- 5-nitro-2-amino-anisole (C.I. No. 37125)
- 5-nitro-2-amino-toluene (C.I. No. 37100)
- 5-nitro-4-amino-anisole (C.I. No. 37135)

aminosulphonic acid amides for example
- 2-amino-anisole-4-sulphonic acid diethylamide (C.I. No. 37150)
- 2-amino-anisole-4-sulphonic acid n-butylamide (C.I. No. 37151)

aminonitriles for example 1-amino-2,5-dimethoxy-4-benzonitrile (C.I. No. 37170)

benzoylphenylenediamines for example
- 1-amino-4-benzoylamino-2,5-dimethoxy-benzene (C.I. No. 37155)
- 1-amino-4-benzoylamino-2,5-diethoxy-benzene (C.I. No. 37175)
- 2-amino-4-methyl-5-benzoylamino-anisole (C.I. No. 37165)

diaminodiphenyls for example o-tolidine (C.I. No. 37230)
dianisidine (C.I. No. 37235)

and other amines used in ice color dyeing may be employed.

The solutions of amines required for the inventive process are obtained by dissolving readily soluble salts of these bases in acid aqueous liquids.

The base dispersions required for the inventive process may be prepared according to various methods.

For example, the dispersion may be obtained by grinding the amine in an aqueous paste, advantageously in the presence of a dispersing agent in order to avoid formation of agglomerations. This operation may be carried out in a rolling or vibration mill charged with balls; especially suitable is a ball mill with an agitator charged with glass beads or natural sand. Pulverisation by means of the so-called dissolver may also give satisfactory results.

According to another mode of operation a solid preparation may be introduced into water; this preparation may be obtained by spray drying a base dispersion containing a solid dispersing agent, or by grinding a mixture of a solid dispersing agent and the amine, for example in a disc attrition mill.

Suitable dispersions may also be obtained by introducing a solution of the base and an appropriate dispersing agent in a water-soluble organic solvent into the aqueous padding liquor.

The dispersing agents used may be of the cationic, anionic or nonionic kind and may, for example, belong to the following classes of substances: alkyl-polyglycol ethers, such as addition products of the alkylene oxide to fatty alcohol, for example, stearyl or oleyl alcohol or coconut fatty alcohol; alkylaryl-polyglycol ethers, for example addition products of alkylene oxide to nonylphenol; aryl-polyglycol ethers; alkylamino-oxethylates; trialkyl-aralkyl-ammonium salts, for example, trialkylbenzyl-ammonium chlorides; trialkyl-phosphine oxides, for example dodecyl-dimethyl-phosphine oxide; alkyl-arylsulphonates, such as the sodium salt of isobutyl-naphthalenesulphonic acid; arylsulphonates, lignin-sulphonates; sulphonated cresol/formaldehyde resins; formaldehyde/naphthalenesulphonic acid condensation products; carbacyl-amino-sulphonic acids, such as N-oleyl-N-methyl-taurine, and similar substances.

Especially suitable dispersing agents are polyalkyleneglycol ethers of the formula $$R-O-Ar-CH_2-Ar-O-(CH_2-CH_2-O)_n-R$$

where R is an alkyl radical having from 1 to 3 carbon atoms, Ar is an alkylene radical, preferably a phenylene radical, and n is an integer from 7 to about 50.

In order to obtain level dyeings according to the invention, the maximum grain size of the dispersed amine should be 0.03 mm or less.

Emulsions of the amines can be prepared, for example, by introducing solutions of the said substances in mixtures of surface-active agents and water-soluble organic solvents or surface-active-agents alone. Suitable surface-active agents are, especially, ethylene oxide addition products, suitable organic solvents are, especially, alkylmono- or diglycol ether or ethylene glycol alone.

As disperse dyes can be used in this invention any types compatible with nitrite and usable for the dyeing of polyester fibers according to the thermosol process. Those products are sufficiently known and are registered in Color Index, 3rd edition (1971), volume 2, under the classifying name of "Disperse Dyes."

In the inventive process the disperse dyes must present the usual degree of fine dispersion in the padding liquor. They can be used, in this case, as liquid preparations which are obtained by grinding in an aqeuous paste of the dyestuff with a dispersing agent in a suitable grinding aggregate. However, they can also be used as solid preparations, which can be prepared, for example by spraying a concentrated aqueous dispersion containing a suitable dispersing agent, in a spray dryer.

Suitable acidifiers for use in the second padding liquors used in the process of the invention in order to promote formation of the diazonium compound from the amine and the nitrite and thus to ensure coupling with formation of the azo dyestuff, are generally organic acids, for example, formic, acetic, glycolic, lactic, gluconic, tartaric, or citric acid, or mixtures of these acids. On the other hand, certain inorganic acidic salts, for example, monosodium-dihydrogen phosphate, sodium hydrogen sulfate or aluminium sulfate may also be used.

The following Examples illustrate the invention. The Color Index numbers cited are taken from the 3rd edition, 1971, quantities and percentages of substances indicated are by weight, unless stated otherwise.

EXAMPLE 1

6 Parts of 2-hydroxynaphthalene-3-carboxylic acid-phenyl amide were introduced into a bath heated to about 95°C consisting of 1000 parts of water, 8 parts of a protein degradation product/fatty acid condensate and 5 parts of sodium hydroxide and dissolved by boiling, whereafter 10 parts of a sodium nitrite were added. This hot solution was used to pad a polyester fiber/cotton blend (in the ratio 67:33) on a padding machine. The liquor uptake was 600 g/kg of dry material.

After a short-time exposition to air, the material was dried.

The material so treated was now cross-padded on a second padding machine in a dye-bath of room temperature (the liquor uptake being 600 g/kg of dry material) which was prepared by introducing 10 parts of a 45 % aqueous dispersion of 5-nitro-2-amino-anisole and 50 parts of the disperse dye of the formula

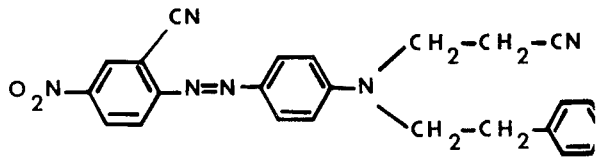

in a solution of 8 parts of castor oil-ethylene oxide condensate in 900 parts of water and subsequent addition of 15 parts of lactic acid and 20 parts of tartaric acid. After an immediately following intermediate drying the padded material was thermosoled at 210°C for 60 seconds to fix the disperse dyestuff. Then, the dyeing was rinsed, soaped, washed and dried as usual. The result was a full, level blue-tinge red dyeing on both fiber portions of the blended fabric.

EXAMPLE 2 a fabric impregnated as described in Example 1 was cross-padded with a dyebath of room temperature (liquor uptake: 600 g/kg of dry material), which was prepared by introducing 8 parts of a 55 % aqueous dispersion of 4,4'-diamino-3,3'-dimethoxy-diphenyl and 50 parts of the disperse dyestuff of the formula

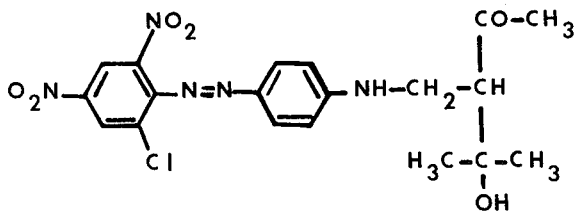

in a solution of 8 parts of a castor oil-ethylene oxide condensation product in 900 parts of water and subsequent addition of 20 parts of 50 % gluconic acid and 20 parts of a 60 % acetic acid. After an immediately following intermediate drying the textile material so treated was thermosoled at 210°C for 60 seconds to fix the disperse dyestuff. Then, the dyeing was rinsed, soaped, washed and dried as usual. The result was a full, level dark-blue dyeing on both fiber portions.

EXAMPLE 3

Dyeing was carried out by cross-padding a fabric impregnated according to Example 1 with a dyebath of room temperature (liquor uptake 600 g/kg of dry material) which was prepared by introducing 10 parts of a 50 % aqueous dispersion of 4-amino-2,5-dimethoxybenzonitrile, 20 parts of the disperse dye of the formula

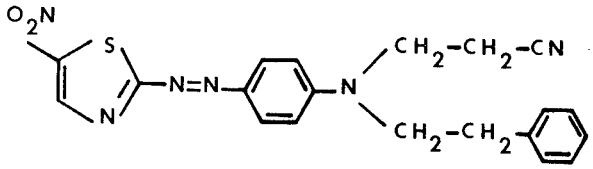

and 30 parts of the disperse dyestuff of the formula

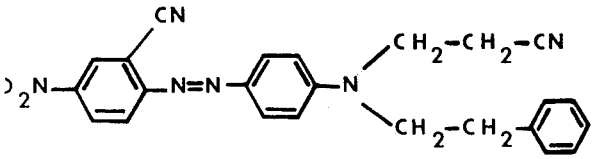

in a solution of 8 parts of a castor oil-ethylene oxide condensation product in 900 parts of water and subsequent addition of 10 parts of a 85 % formic acid and 10 parts of lactic acid. The disperse dyestuff was dried and fixed and the dyeing was after-treated as described in Example 1. The result was a full, level bordo dyeing on both fiber portions.

EXAMPLE 4

Dyeing was carried out by cross-padding an impregnated material as described in Example 1 with a dyebath of room temperature (liquor uptake 600 g/kg of dry material), which was prepared by introducing 10.5 parts of a 50 % aqueous dispersion of 5-amino-2-benzoylamino-4-methoxy-1-methyl-benzene, 30 parts of the disperse dyestuff of the formula

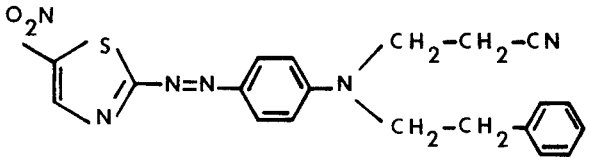

and 10 parts of the disperse dyestuff of the formula

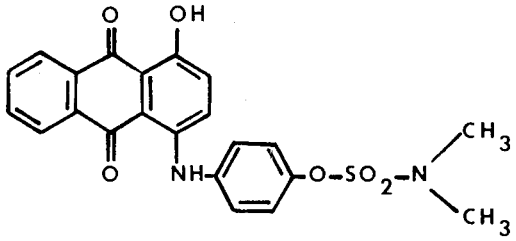

in a solution of 8 parts of a castor oil-ethylene oxide condensation product and subsequent addition of 10 parts of lactic acid and 10 parts of a 85 % formic acid. The disperse dyestuff was dried and fixed and the dyeing was after-treated as described in Example 1. The result was a violet dyeing.

We claim:

1. In a process for the continuous dyeing of textile material consisting of blends of polyester and cellulose fibers with disperse dyestuffs and water-insoluble azo dyestuffs produced on the fiber, the improvement which comprises: padding the fibrous material with an aqueous solution which contains at least one component capable of entering azo coupling and which is suitable for ice-color dyeing, sodium hydroxide and sodium nitrite, subsequently crosspadding the material so treated with a second aqueous bath at room temperature which contains a solution, a dispersion or an emulsion of at least one amine capable of being diazotized and which is suitable for ice-color dyeing, at least one disperse dyestuff and an acidic agent, and then successively causing formation of the azo dyestuff on the fibers by diazotizing and coupling as well as fixing the disperse dyestuff by subjecting the material to an elevated temperature.

2. A process as claimed in claim 2, wherein the aqueous solution of the coupling component is hot.

3. A process as claimed in claim 2, wherein the coupling component is an arylamide of acetoacetic acid, of a 2-hydroxy-naphthalene-3-carboxylic acid or of a heterocyclic o-hydroxy-carboxylic acid.

4. A process as claimed in claim 2, wherein the material padded with the aqueous solution of the coupling component is dried before the cross-padding operation.

5. A process as claimed in claim 2, wherein the diazotizable amine is used in the form of the free base or a salt.

6. A process as claimed in claim 2, wherein the diazotizable amine is a nitroaniline, amino-sulfonic acid amide, amino-nitrite, benzoyl-phenylene-diamine or diamino-diphenyl.

7. A process as claimed in claim 2, wherein the disperse dyestuff used is of the azo or anthraquinone series.

8. A process as claimed in claim 2, wherein the disperse dyestuff is fixed according to the thermosol process.

* * * * *